US007188628B2

(12) United States Patent
Shubert et al.

(10) Patent No.: US 7,188,628 B2
(45) Date of Patent: Mar. 13, 2007

(54) FINGERNAIL TRIMMER HAVING ROTATIONALLY OSCILLATING ABRASIVE SURFACE

(76) Inventors: Lawrence G. Shubert, 1507 Harbor Blvd., Belmont, CA (US) 94002; David E. Mallard, 4256 Ruthelma Ave., Palo Alto, CA (US) 94306; Lynda A. Deakin, 1607 18th St., San Francisco, CA (US) 94107; Daniel S. Bomze, 512 Laguna St., San Francisco, CA (US) 94110

( * ) Notice: Subject to any disclaimer, the term of this patent is extended or adjusted under 35 U.S.C. 154(b) by 0 days.

(21) Appl. No.: 10/087,458

(22) Filed: Feb. 27, 2002

(65) Prior Publication Data

US 2004/0182409 A1 Sep. 23, 2004

(51) Int. Cl.
*A45D 29/18* (2006.01)

(52) U.S. Cl. ..... 132/73.6; 132/76.4

(58) Field of Classification Search ..... 132/73.6, 132/75.6, 76.4, 76.5; 451/163, 539; D28/56, D28/57, 58

See application file for complete search history.

(56) References Cited

U.S. PATENT DOCUMENTS

| | | | | | |
|---|---|---|---|---|---|
| 2,350,098 | A | * | 5/1944 | Decker | 451/356 |
| 2,877,775 | A | * | 3/1959 | Hall | 132/73.6 |
| 2,923,303 | A | | 2/1960 | Hundt | |
| 3,053,063 | A | * | 9/1962 | Lilleberg | 464/87 |
| 3,311,117 | A | | 3/1967 | Thompson | |
| 4,117,854 | A | | 10/1978 | Rosenbloom | |
| 4,408,623 | A | | 10/1983 | Murray | |
| 4,440,182 | A | | 4/1984 | Holm | |
| 4,643,207 | A | * | 2/1987 | Grahame | 132/73.6 |
| 4,683,897 | A | | 8/1987 | McBride | |
| 4,854,334 | A | | 8/1989 | Su | |
| 5,033,485 | A | | 7/1991 | Hauerwas et al. | |
| 5,287,863 | A | * | 2/1994 | La Joie et al. | 132/76.4 |
| 5,309,681 | A | * | 5/1994 | Cheney et al. | 451/344 |
| 5,390,449 | A | * | 2/1995 | Hilton | 451/526 |
| 5,637,034 | A | * | 6/1997 | Everts et al. | 451/344 |
| 5,716,263 | A | * | 2/1998 | Jones et al. | 451/344 |
| 5,759,093 | A | | 6/1998 | Rodriguez | |
| 6,050,270 | A | * | 4/2000 | Tyshenko, Jr. | 132/73.6 |
| 6,062,960 | A | * | 5/2000 | Kai et al. | 451/357 |
| 6,099,397 | A | * | 8/2000 | Wurst | 451/344 |
| 6,145,512 | A | * | 11/2000 | Daley | 132/76.4 |
| 6,227,959 | B1 | * | 5/2001 | Beaudry | 451/526 |
| 6,503,082 | B1 | * | 1/2003 | Takahashi | 433/125 |

FOREIGN PATENT DOCUMENTS

| | | | | |
|---|---|---|---|---|
| DE | 3400375 | A1 | * | 7/1985 |
| JP | 06277114 | A | * | 10/1994 |
| JP | 11235227 | A | * | 8/1999 |
| JP | 2000-175733 | | | 6/2000 |
| JP | 2001037536 | A | * | 2/2001 |
| JP | 2001-333817 | | | 12/2001 |

* cited by examiner

*Primary Examiner*—Todd E. Manahan
(74) *Attorney, Agent, or Firm*—Much Shelist; Adam Sacharoff

(57) ABSTRACT

A nail trimmer apparatus as porvided by the present invention is a small handheld battery powered device that trims nails without damaging the surrounding skin. A trimming action is driven by a compact motor at a predefined speed and torque and a mechanism converts the rotation of a motor shaft to an oscillating action at a head. A cushioned abrasive surface attached to the head oscillates with a frequency and stoke that optimizes the trimming of the nail while not adversely affecting surrounding skin.

18 Claims, 3 Drawing Sheets

FINGERNAIL TRIMMER HAVING ROTATIONALLY OSCILLATING ABRASIVE SURFACE

BACKGROUND OF THE INVENTION

The present invention relates to trimming nails on fingers and toes. In particular, the invention provides a method and apparatus for trimming finger or toe nails for infants. More particularly, the invention provides an improved method for selectively applying a moving abrasive surface, which is coupled to a shock absorbing material, to both a finger or toe nail and any surrounding skin portion without causing physical damage (e.g., cuts, bleeding, bruising to such skin portion. Merely by way of example, the invention has been applied to delicate fingers and toes of infants. But it would be recognized that the invention has a much broader range of applicability including pets, adults, children, toddlers, the elderly and infirm, and other beings.

Newborns have soft and tender bodies, limbs, and fingers and toes that are often delicate and prone to injury. Yet thin flexible fingernails quickly protrude from such fingers and toes. Although such nails may appear harmless at first glance, they nonetheless cause injuries to the infant. That is, new born infants do not have adequate control of arm, hand, and finger movements and often inadvertently claw at their face. Nails that are ragged or extend beyond the tip of the finger often cause scratches to the face and eyes. Accordingly, such nails should be trimmed in a neat easy and safe manner.

One common way of trimming infant finger or toe nails is the use of conventional clipping devices. Such clipping devise often include a pair of razor sharp knife edges, which must come together to sheer a nail. Unfortunately, such devices are often dangerous and difficult to use on a moving infant. Given the small size of the infant's fingers and toes and softness of the nail, it is easy to accidentally clip the tip of the baby's finger or toe while trimming the nail, causing damage to such finger or toe including bleeding, nerve related injuries, and others. Often times, parents also become emotionally injured by harming their own children. Accordingly, some parents have used small scissors for more control. Such scissors often require a little more dexterity. Since children are often difficult to control, trimming of nails often occurs when the infant is asleep or feeding which makes the trimming process even more complex.

There have also been attempts to manufacture mechanical devices for trimming nails. An example of such a device is described in Vibrating Nail Trimming issued as U.S. Pat. No. 4,328,819, in the name of Everett L. Haas (the '819 patent). The '819 patent generally relates to a hand-held vibrating nail trimming which facilities the management of finger or toe nails. The hand-held nail trimming uses a blade connected to an elongated drive shaft for severing a nail as the blade moves back and forth. Unfortunately, as the blade severs the nail, other bodily parts such as limb and skin often sever as well. Additionally, such trimming appears unsafe for use with the thin delicate fingers and toes of an infant. Accordingly, such conventional devices have many limitations.

From the above, it is seen that an improved way of trimming nails is highly desirable.

BRIEF SUMMARY OF THE INVENTION

According to the present invention, techniques for trimming nails on fingers and toes are provided. In particular, the invention provides a method and apparatus for trimming finger or toe nails for infants. More particularly, the invention provides an improved method for selectively applying a moving abrasive surface, which is coupled to a shock absorbing material, to both a finger or toe nail and any surrounding skin portion without causing physical damage (e.g., cuts, bleeding, bruising) to such skin portion. Merely by way of example, the invention has been applied to delicate fingers and toes of infants. But it would be recognized that the invention has a much broader range of applicability including pets, adults, children, toddlers, the elderly and infirm, and other beings.

In a specific embodiment, the invention provides a method for trimming nails. The method includes applying an abrasive surface (e.g., emery board, sanding paper, or other abrasive compound) coupled to a moving member against both an extended nail portion and a surrounding epidermal tissue portion to cause a grinding action on the extended nail portion. The abrasive surface is coupled to the moving member (e.g., oscillating, rotating, vibrating, laterally moving) being driven by an electric drive device coupled to the moving member. The abrasive surface applied to both the extended nail portion and the surrounding epidermal tissue portion is characterized by a predetermined speed, a predetermined action, and a selected texture to remove the nail portion by the grinding action while maintaining the surrounding epidermal tissue substantially free from any physical damage.

In an alternative specific embodiment, the invention provides an alternative method for trimming nails. The method includes applying an abrasive surface coupled to a moving member against an extended nail portion to initiate a grinding action on the extended nail portion. The abrasive surface is coupled to the moving member being driven by an electric drive device coupled to the moving member. The method also includes protecting the surrounding epidermal tissue using a protective device, where the protective device exposes at least the extended nail portion. The abrasive surface applied to the extended nail portion is characterized by a predetermined speed, a predetermined action, and a selected texture to remove the nail portion by the grinding action while the protective device keeps the surrounding epidermal tissue substantially free from any physical damage.

In an alternative specific embodiment, the invention provides an apparatus for trimming nails. The apparatus has a mobile housing comprising an elongated body member. The apparatus also has an electric drive device within and coupled to the housing. The electric drive device has a transfer member. A movable head is coupled to the transfer member of the electric drive device. The movable head is adapted to receive mechanical energy from the electric drive device through the transfer member. An abrasive surface, which is capable of a grinding action, is coupled to the movable head. A shock absorbing member is coupled between the movable head and abrasive surface. The shock absorbing member is capable of allowing the abrasive member to conform to an irregular (or irregularly shaped) surface. Preferably, the shock absorbing member is a resilient, conforming mechanism (e.g., compliant mechanical means, open or close-celled foam, or other elastomer).

In a specific embodiment, the nail trimmer can be a small handheld battery powered device that safely trims people's nails by leveraging certain physical properties of the skin and nail tissue. A trimming action is driven by a compact motor of appropriate speed and torque and a mechanism that converts the rotation of the motor shaft to an oscillating action at the head. A cushioned abrasive surface attached to the head oscillates with a frequency and stroke that optimizes the trimming of the nail while not adversely affecting surrounding skin. Because of the soft and supple nature of the skin, the oscillating action vibrates the skin while the more rigid nail is trimmed. By selecting a desirable form factor and trimming properties, the device is particularly well suited to trimming infant's nails. Infant's nails are often difficult to trim due to the small size of the finger or toe and nail, the lack of cooperation by the infant and the precision required by existing nail trimming tools. The simple one-handed trimmer does not generally require significant dexterity and can be used whether the infant is asleep or awake. Preferable designs ensure smooth and quiet operation that does not scare the child, and the vibratory action elicits a tickling like feel to the infant's fingers and toes and a sense of calm and confidence for the parent. Thus, the infant's nail can easily be trimmed and smoothed without any chance of injury to the child.

Additionally, the device is also well suited for trimming adult's nails. The trimmer for a larger and thicker adult nail would include a more abrasive and less cushioned pad as well as a stronger motor and more aggressive trimming action. The device is easily used by adults to trim one's own nails or to assist in the trimming of another adult's nails in a care giver situation. Due to the overall form and trimming action, the device is particularly well suited for people with impaired vision as well as limited dexterity and strength in the hands. Of course, there can be other applications as well.

Numerous benefits are achieved using the present invention over conventional techniques. For example, the invention can be made using an ergonomic design that is easy to hold and control with one hand. In other embodiments, the invention allows an angled trimming head positioned for excellent visibility of a nail to be trimmed. Depending upon the type of nail, trimming action can be optimized for adults, infants, or other beings. The present design may be compact for ease of portability. In some embodiments, the invention includes a special cover for the cushioned abrasive pad when it is not in use. Additionally, the invention can provide a visual "target" pattern on the abrasive pad to indicate an optimal or desired cutting location. The pads can also be removable and/or replaced by a user once the pad has been worn out. Additional pads can be stored in the housing in other embodiments. The present invention can be implemented using conventional hardware and powered by conventional batteries, which are disposable or rechargeable, depending upon the application. The invention can also provide a housing, which is smooth and quiet. Depending upon the embodiment, one or more of these benefits or features can be achieved. These and other benefits are described throughout the present specification and more particularly below.

The accompanying drawings, which are incorporated in and form part of the specification, illustrate embodiments of the invention and, together with the description, serve to explain the principles of the invention.

DETAILED DESCRIPTION OF THE INVENTION

According to the present invention, techniques for trimming nails on fingers and toes are provided. In particular, the invention provides a method and apparatus for trimming finger or toe nails for infants. More particularly, the invention provides an improved method for selectively applying a moving abrasive surface, which is coupled to a shock absorbing material, to both a finger or toe nail and any surrounding skin portion without causing physical damage (e.g., cuts, bleeding, bruising) to such skin portion. Merely by way of example, the invention has been applied to delicate fingers and toes of infants. But it would be recognized that the invention has a much broader range of applicability including pets, adults, children, toddlers, the elderly and infirm, and other beings.

Figure 1:
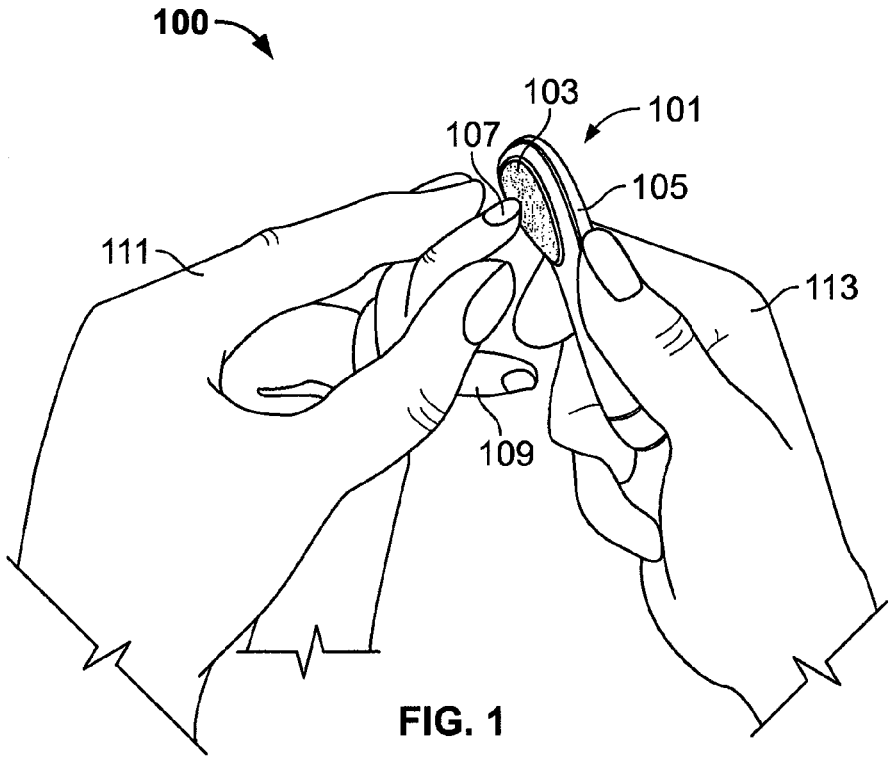
FIGS. 1 through 3 are simplified diagrams of a trimming method according to an embodiment of the present invention.
Figure 2:
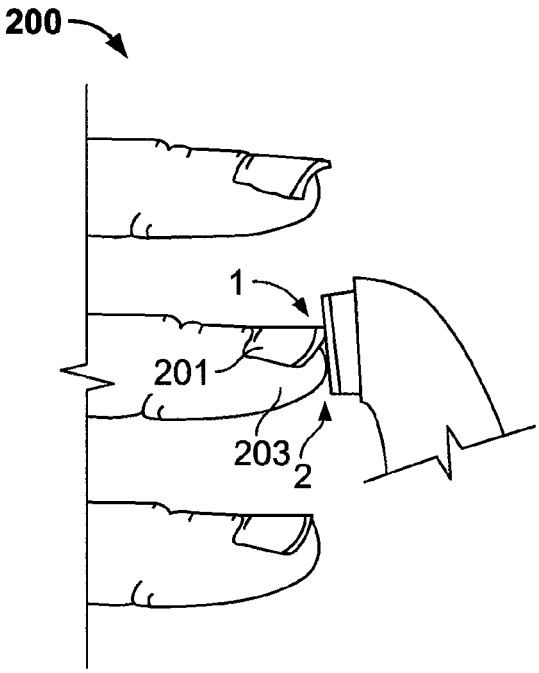
Figure 3:
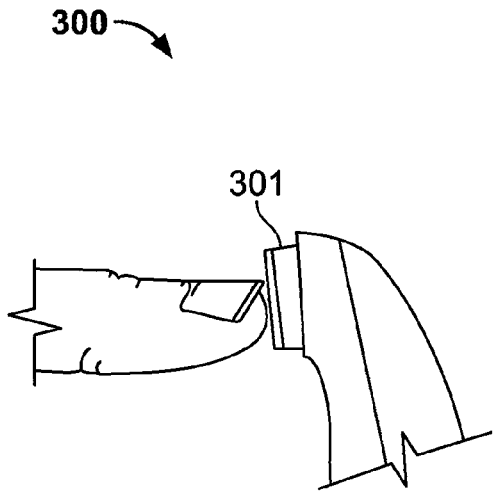

FIGS. 1 through 3 are simplified diagrams 100 of a trimming method according to an embodiment of the present invention. These diagrams are merely examples that should not unduly limit the scope of the claims herein. One of ordinary skill in the art would recognize many other variations, modifications, and alternatives. As shown the trimming method includes a trimming apparatus or device 101, which includes a variety of features. Such features include an oscillating surface 103. Such surface is mounted on a hand held member 105. The hand held member directs the oscillating surface to a nail 107 of an Infant's finger, which is on the infant's hand. The infant's hand 109 and hand held member are held by a pair of adult hands 111, 113 such as those from the infant's mother or father. One hand holds and directs the hand held member while the other hand holds the infant's hand and finger.

Referring to FIG. 2, the method of using a nail trimming device 200 includes applying an abrasive surface 1 coupled to a moving member 2 against both an extended nail portion 201 and a surrounding epidermal tissue portion 203 to cause a grinding action on the extended nail portion. The abrasive surface is coupled to the moving member being driven by an electric drive device coupled to the moving member. The abrasive surface applied to both the extended nail portion and the surrounding epidermal tissue portion is characterized by a predetermined speed, a predetermined action, and a selected texture to remove the nail portion by the grinding action while maintaining the surrounding epidermal tissue substantially free from any physical damage. Preferably, the surrounding epidermal tissue contacts an abrasive surface of the moving member and moves with an action of the abrasive surface, which does not cut or tear the tissue. Once the extended nail has been removed, the moving member is also moved away 300 from the finger, as Illustrated by way of FIG. 3. As shown, the moving member has generally been applied at an angle that is substantially normal to the protruding finger nail. In a specific embodiment, such angle may deviate to about 60 degrees from the normal position.

As also shown, the moving member extends away 301 from the portion to be held by the hand.

Figure 4A:
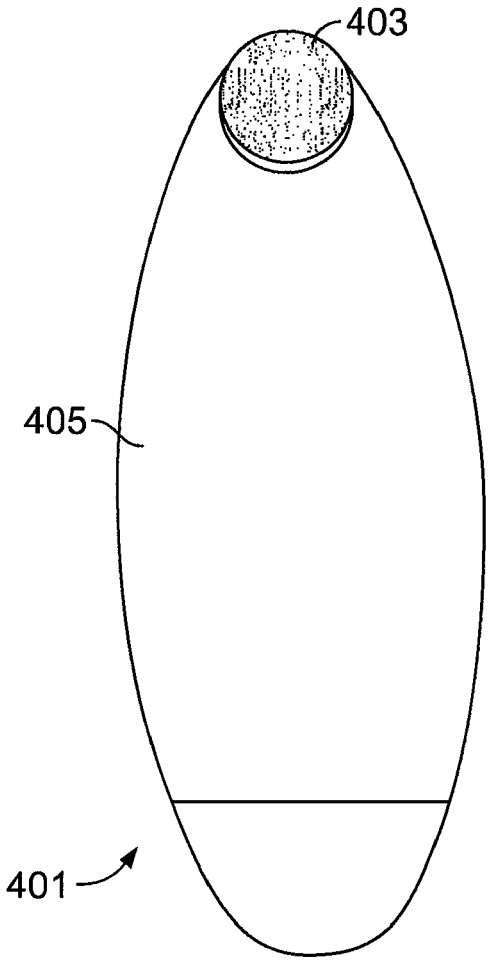
FIGS. 4A and 4B are simplified diagrams of the trimming apparatus according to an embodiment of the present invention showing front and side views, respectively.
Figure 4B:
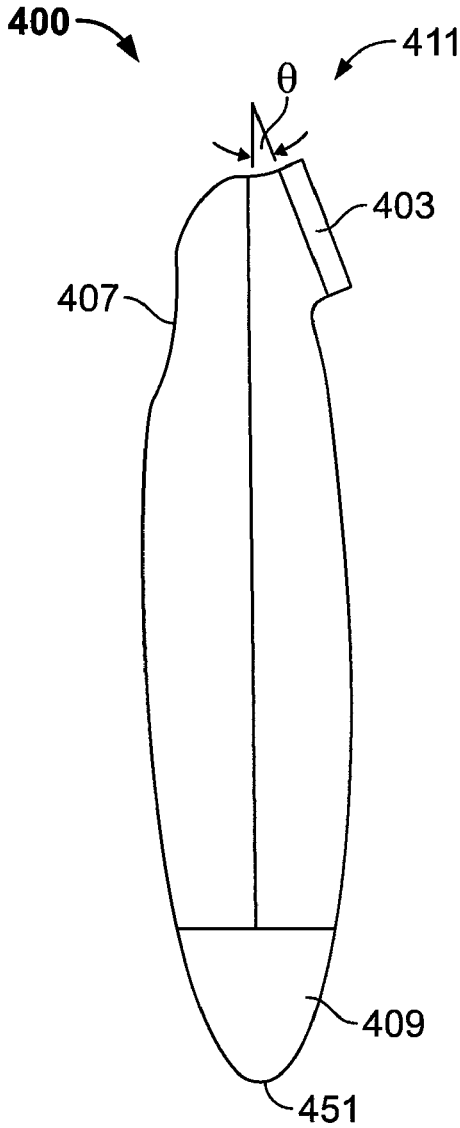

FIGS. 4A and 4B are simplified diagrams of a trimming apparatus 400 according to an embodiment of the present invention. This diagram is merely an example and should not unduly limit the scope of the claims herein. One of ordinary skill in the art would recognize many other variations, modifications, and alternatives. The apparatus 400 is illustrated In a front-view portion 401 and a side view portion 451. The apparatus has a mobile housing comprising an elongated body member 405. An upper portion 407 of the elongated body is intended to be a site from a thumb as index fingers are used as a site on the front portion. A lower portion 409 of the elongated body member is tapered. As shown, the moving surface 403 and elongated body form an angle 411, where the moving surface is not parallel to the elongated body. The angle allows an operator holding the elongated body to position the moving surface toward a finger nail. The angle θ ranges from about 0 degrees to about 90 degrees. Further details of the apparatus are provided below.

Figure 5:
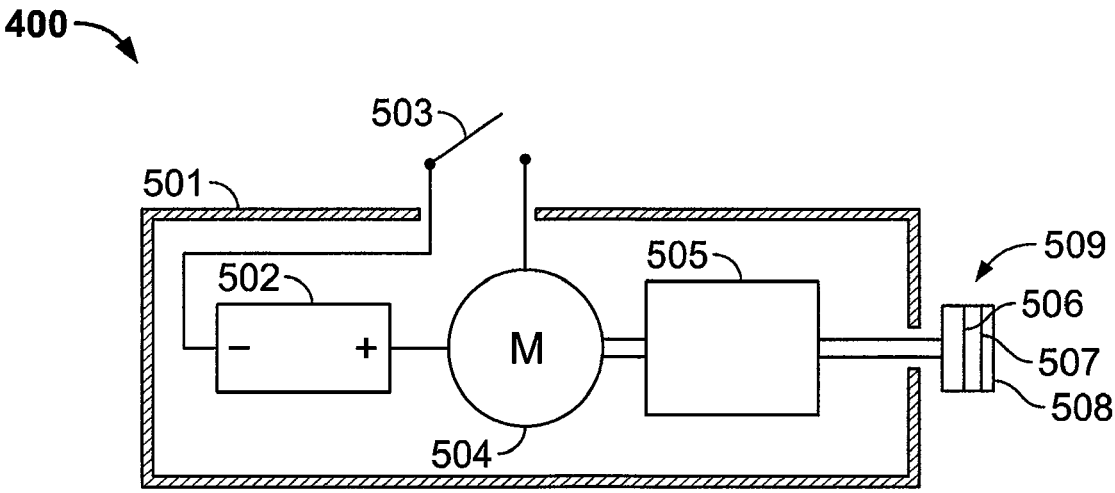
FIG. 5 is a system diagram of the trimming apparatus according to an embodiment of the present invention.

FIG. 5 Is a system diagram of the trimming apparatus 400 according to an embodiment of the present invention. This diagram is merely an example and should not unduly limit the scope of the claims herein. One of ordinary skill in the art would recognize many other variations, modifications, and alternatives. The apparatus 400 has an electric drive device within and coupled to the housing 501 and coupled via a switch 503 to a power supply 502. The electric drive device has a transfer member 505, which causes rotational movement or other movement. A movable head 509, which may be removable and replaceable, is coupled to the transfer member of the electric drive device. The movable head is adapted to receive mechanical energy from the electric drive device 504 through the transfer member. An abrasive surface 508, which is capable of a grinding action, is coupled to the movable head. A shock absorbing member 507 is coupled between the movable head and the abrasive surface. The shock absorbing member is capable of allowing the abrasive member to conform onto a non-conformal surface. The shock absorbing member is coupled to moveable head member 506, which connects to the drive device. Further details of the head are provided more fully below.

Figure 6A:
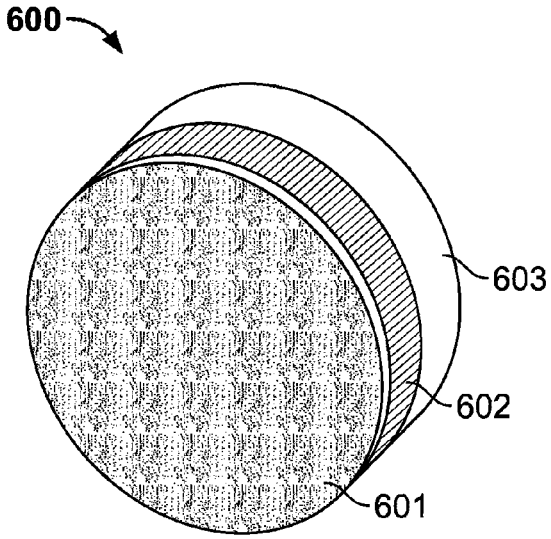
FIGS. 6A and 6B are more detailed diagrams of a trimming head according to an embodiment of the present invention showing oblique and side views, respectively.
Figure 6B:
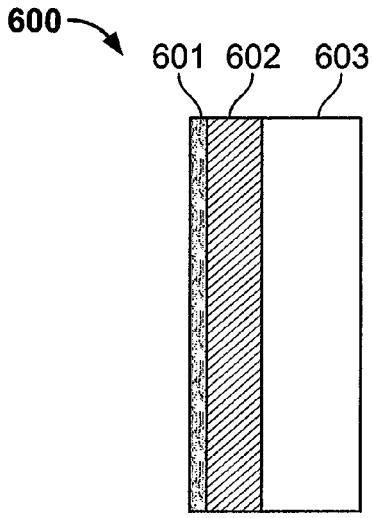

FIGS. 6A and 6B are more detailed diagrams of a trimming head 600 according to an embodiment of the present invention. This diagram is merely an example and should not unduly limit the scope of the claims herein. One of ordinary skill in the art would recognize many other variations, modifications, and alternatives. As shown, the trimming head includes abrasive surface 601, which couples to shock absorbing material 602. The shock absorbing material 602 couples to rigid substrate 603. Depending upon the embodiment, there can also be other layers, which are sandwiched between any of these layers. Of course, such layers will depend highly upon the application.

Figure 7A:
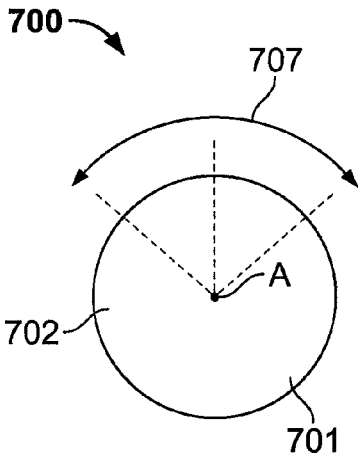
FIGS 7A–7C are schematic elevation views of rotating patterns of the head according to an embodiment of the present invention.
Figure 7B:
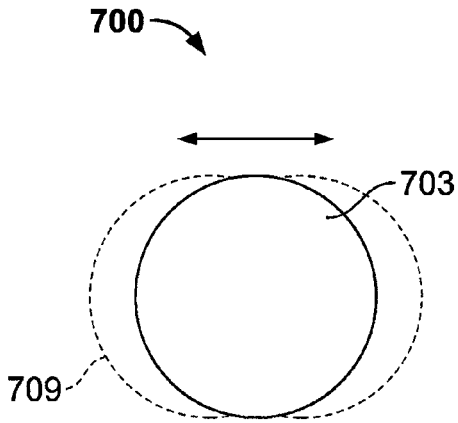
Figure 7C:
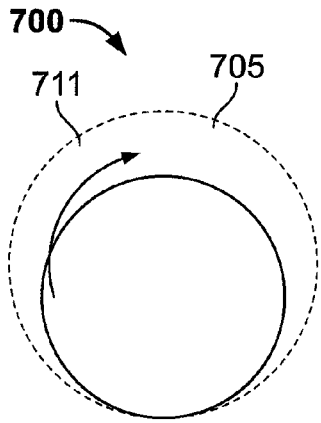

FIGS. 7A–7C are schematic elevational views of rotating patterns 700 of the head according to an embodiment of the present invention. This diagram is merely an example and should not unduly limit the scope of the claims herein. One of ordinary skill in the art would recognize many other variations, modification, and alternatives. As shown, the rotating patterns include oscillation, which moves the abrasive member 701 about a fixed arc 707. In the embodiment shown, abrasive member 701 has a circular abrasive surface 702 and fixed arc 707 is drawn about an axis A about which abrasive member 701 rotationally oscillates. It may be seen that axis A passes through the abrasive surface 702 at its center. The arc can range from about 5 degrees to about 180 degrees. The rotating pattern can also include lateral movement 709, which moves the head 703 up to 3 times the width of the head. Alternatively, the rotating pattern can include orbital movement 705, 711. Depending upon the embodiment, any of the above movements can be combined with each other or with others that have not been described. The movements can be variable or constant or any combination of these, depending upon the application.

Figure 8:
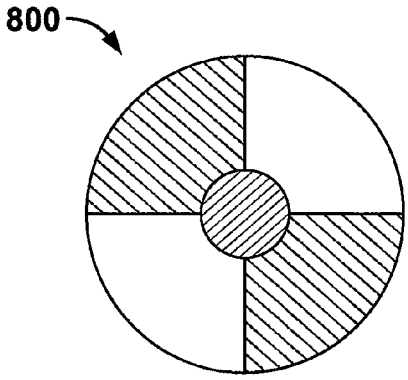
FIG. 8 is a simplified diagram of an abrasive disk face according to an embodiment of the present invention.

FIG. 8 is a simplified diagram 800 of an abrasive disk face according to an embodiment of the present invention. This diagram is merely an example and should not unduly limit the scope of the claims herein. One of ordinary skill in the art would recognize many other variations, modifications, and alternatives. As shown, the diagram 800 includes a pattern, which can be visually seen by a user of the trimming apparatus. Depending upon the embodiment, the pattern can be provided in a way where a user could direct the moving surface toward the nail. Of course, there can be many other ways of providing patterns.

While the invention is described in conjunction with the preferred embodiments, this description is not intended in any way as a limitation to the scope of the invention. Modifications, changes, and variations, which are apparent to those skilled in the art can be made in the arrangement, operation and details of construction of the invention disclosed herein without departing from the spirit and scope of the invention.

What is claimed is:

1. An apparatus for trimming a person's nails, the apparatus comprising:

an elongated mobile housing having a shape and size suitable for being held in a single hand of a user;

an electric drive device within and coupled to the mobile housing, the electric drive device having a transfer member;

a power supply contained within the mobile housing to supply power to the electric drive device when activated by a switch;

a movable head positioned on the mobile housing and coupled to the transfer member of the electric drive device, the movable head being adapted to receive mechanical energy from the electric drive device through the transfer member so as to rotationally oscillate through a fixed arc about an axis;

an abrasive surface coupled to the movable head such that the axis passes through the abrasive surface, the abrasive surface having a grit adapted to trim a person's nail when oscillating, wherein; and a shock absorbing member coupled between the movable head and the abrasive surface, the shock absorbing member providing shock absorption to allow the abrasive surface to conform to a person's nail.

2. The apparatus of claim 1 wherein the shock absorbing member is a resilient, conforming layer of material sandwiched between the movable head and the abrasive surface that is selected from a foam or elastomer.

3. The apparatus of claim 1 wherein the movable head oscillates through an arc in the range of about 5 to 180 degrees.

4. The apparatus of claim 1, wherein the abrasive surface is removable from the movable head.

5. The apparatus of claim 1, wherein the abrasive surface has a graphic design to provide a pattern during movement of the movable head.

6. An apparatus for trimming a person's nails, the apparatus comprising:

an elongated mobile housing having a shape and size suitable for being held in a single hand of a user;

an electric drive device within and coupled to the mobile housing, the electric drive device having a transfer member;

a power supply contained within the mobile housing to supply power to the electric drive device when activated;

a movable head positioned on the mobile housing and coupled to the transfer member of the electric drive device, the movable head being adapted to rotationally oscillate through a fixed arc about an axis; and an abrasive surface coupled to the movable head such that the axis passes through the abrasive surface, the abrasive surface having a grit adapted to trim a person's nail when oscillating.

7. The apparatus of claim 6 further comprising:

a shock absorbing member disposed between the movable head and abrasive surface, the shock absorbing member being configured to allow the abrasive member to conform around a person's nail, the shock absorbing member comprising a resilient, conforming layer of resilient material sandwiched between the movable head and the abrasive surface.

8. The apparatus of claim 6 wherein the power supply comprises a battery.

9. The apparatus of claim 6 wherein the electric drive device is adapted to oscillate the head through an arc in the range of about 5 to about 180 degrees.

10. An electric nail trimmer comprising:

an elongated body having a size and shape suitable for being grasped in a single hand of a user, the elongated body having first and second ends and a longitudinal axis therebetween;

an electric drive device secured within the body, the electric drive device having a transfer member;

a power supply within the body to supply power to the electric drive device when activated;

a movable head positioned near the first end of the body, the movable head coupled to the transfer member of the electric drive device such that the movable head rotationally oscillates through a fixed arc about an axis;

an abrasive surface coupled to the working surface of the movable head such that the axis passes through the abrasive surface, the abrasive surface having a grit selected to trim a person's nail when oscillating and a shock absorbing member disposed between the movable head and abrasive surface, to allow the abrasive member to conform around a person's nail, whereby when activated the abrasive surface oscillates to trim a person's nail while the person's epidermal tissue surrounding the nail remains unharmed.

11. An apparatus for trimming a person's nails, the apparatus comprising:

an elongated mobile housing having a shape and size suitable for being held in a single hand of a user;

an electric drive device within and coupled to the mobile housing, the electric drive device having a transfer member;

a movable head positioned on the mobile housing and coupled to the transfer member of the electric drive device, the movable head having a size substantially smaller than the user's hand, the movable head being adapted to receive mechanical energy from the electric drive device through the transfer member so as to rotationally oscillate through a fixed arc about an axis;

an abrasive surface coupled to the movable head such that the axis passes through the abrasive surface, the abrasive surface having a grit adapted to trim a person's nail when oscillating; and a shock absorbing member coupled between the movable head and abrasive surface, the shock absorbing member providing shock absorption to allow the abrasive surface to conform to a person's nail.

12. The apparatus of claim 11 further comprising a power supply within the elongated mobile housing to supply power to the electric drive device when activated.

13. The apparatus of claim 11 wherein the electric drive device is adapted to oscillate the head through an arc in the range of about 5 to about 180 degrees.

14. An apparatus for trimming a person's nails, the apparatus comprising:

an elongated mobile housing having a shape and size suitable for being held in a single hand of a user;

an electric drive device within and coupled to the mobile housing, the electric drive device having a transfer member;

a movable head positioned on the mobile housing the movable head being adapted to receive mechanical energy from the electric drive device through the transfer member so as to rotationally oscillate through a fixed arc about an axis;

an abrasive surface coupled to the movable head such that the axis passes through the abrasive surface, the abrasive surface having a grit adapted to trim a person's nail when oscillating; and a shock absorbing member coupled between the movable head and abrasive surface, the shock absorbing member providing shock absorption to allow the abrasive surface to conform to a person's nail, the shock absorbing member comprising a resilient, conforming layer of resilient material sandwiched between the movable head and the abrasive surface.

15. The apparatus of claim 14 wherein the movable head oscillates through an arc in the range of about 5 to about 180 degrees.

16. An apparatus for trimming a person's nails, the apparatus comprising:

a housing having a shape and size suitable for being held in a single hand of a user;

an electric drive device within the housing;

a movable head positioned on the housing and coupled to the electric drive device, the movable head being adapted to rotationally oscillate through a fixed arc about an axis; and an abrasive surface coupled to the movable head such that the axis passes through the abrasive surface, the abrasive surface being adapted to trim or smooth a person's nail when oscillating.

17. The apparatus of claim 16 wherein the movable head oscillates through an arc in the range of about 5 to about 180 degrees.

18. The apparatus of claim 16 further comprising a shock absorbing member disposed between the movable head and the abrasive surface adapted to allow the abrasive surface to conform to a person's nail, the shock absorbing member comprising a resilient, conforming layer of resilient material sandwiched between the movable head and the abrasive surface.

* * * * *